US009911562B2

(12) United States Patent
Bissal et al.

(10) Patent No.: US 9,911,562 B2
(45) Date of Patent: Mar. 6, 2018

(54) THOMSON COIL BASED ACTUATOR

(71) Applicant: ABB SCHWEIZ AG, Baden (CH)

(72) Inventors: Ara Bissal, Stockholm (SE); Ener Salinas, Västerås (SE)

(73) Assignee: ABB SCHWEIZ AG, Baden (CH)

( * ) Notice: Subject to any disclaimer, the term of this patent is extended or adjusted under 35 U.S.C. 154(b) by 0 days.

(21) Appl. No.: 15/308,774

(22) PCT Filed: May 14, 2014

(86) PCT No.: PCT/EP2014/059859
§ 371 (c)(1),
(2) Date: Nov. 3, 2016

(87) PCT Pub. No.: WO2015/172824
PCT Pub. Date: Nov. 19, 2015

(65) Prior Publication Data

US 2017/0154747 A1 Jun. 1, 2017

(51) Int. Cl.
*H01H 75/00* (2006.01)
*H01H 50/20* (2006.01)
(Continued)

(52) U.S. Cl.
CPC ..... *H01H 50/20* (2013.01); *H01H 50/02* (2013.01); *H01H 50/443* (2013.01); *H01H 71/24* (2013.01)

(58) Field of Classification Search
CPC ..... H01H 50/443; H01H 50/20; H01H 50/02; H01H 71/24; H01H 50/46;
(Continued)

(56) References Cited

U.S. PATENT DOCUMENTS 3,525,963 A * 8/1970 Burdett ..... H01F 7/066 335/254
3,534,304 A * 10/1970 Robinson ..... H01H 33/666 335/16
(Continued)

FOREIGN PATENT DOCUMENTS

WO WO 2011/003547 A1 1/2011
WO WO 2014/000790 A1 1/2014
WO WO 2014/056487 A2 4/2014

OTHER PUBLICATIONS

Bissal et al., "Simulation and verification of Thomson actuator systems", COMSOL Conference Paris 2010, Nov. 19, 2010, XP055155080, Stockholm, Retrieved from the Internet on Nov. 26, 2014: URL:www.comsol.de/papers/8290/download/bissal_presentation.pdf, total 26 pages, pp. 3-4.
(Continued)

*Primary Examiner* — Shawki S Ismail
*Assistant Examiner* — Lisa Homza
(74) *Attorney, Agent, or Firm* — Birch, Stewart, Kolasch & Birch, LLP

(57) ABSTRACT

An actuator for a mechanical switch, a mechanical switch, a circuit breaker and a high voltage power transmission system including such an actuator are disclosed. The actuator includes at least one armature and a first primary coil with turns wound around a central coil axis, where the armature is movable along the central coil axis and there is a magnetic flux concentrator provided at least around the first primary coil.

20 Claims, 4 Drawing Sheets

(51) Int. Cl.
*H01H 50/02* (2006.01)
*H01H 50/44* (2006.01)
*H01H 71/24* (2006.01)

(58) Field of Classification Search
CPC . H01H 53/00–53/14; H01H 2071/2427; H01F 7/1205
USPC ..... 335/6
See application file for complete search history.

(56) References Cited

U.S. PATENT DOCUMENTS 4,215,328 A * 7/1980 Chabot ..... H01H 71/1009 335/170
4,491,816 A * 1/1985 Blum ..... H01F 7/081 335/245
5,281,936 A * 1/1994 Ciezarek ..... H01P 1/125 333/103
5,381,121 A * 1/1995 Peter ..... H01H 71/46 335/14
5,394,131 A * 2/1995 Lungu ..... F16D 67/06 251/129.01
5,652,558 A * 7/1997 Leikus ..... H01H 11/0006 333/105
5,752,308 A 5/1998 Maley et al.
6,518,865 B1 * 2/2003 Al-Hosini ..... H01H 33/285 335/147
6,657,150 B1 * 12/2003 Shea ..... H01H 3/3031 218/154
7,347,221 B2 * 3/2008 Berger ..... F16K 1/443 137/614.18
7,623,010 B2 * 11/2009 Liu ..... H01H 50/32 335/107
7,800,275 B2 * 9/2010 Calley ..... H02K 21/12 310/257
7,830,231 B2 * 11/2010 Carlino ..... H01H 71/322 335/102
8,272,622 B2 9/2012 Caldwell
9,183,996 B2 * 11/2015 Karlstrom ..... H01H 3/60
2002/0044036 A1 4/2002 Akita et al.
2003/0052756 A1 * 3/2003 Bollinger ..... H01H 71/2409 335/6
2003/0189473 A1 * 10/2003 Lang ..... H01F 7/1623 335/132
2006/0061442 A1 3/2006 Brooks
2006/0226939 A1 * 10/2006 Dimig ..... E05B 81/00 335/205
2006/0226941 A1 * 10/2006 Dimig ..... F16D 27/112 335/220
2006/0226942 A1 * 10/2006 Dimig ..... B60R 25/02 335/220
2006/0238285 A1 * 10/2006 Dimig ..... F16D 27/025 335/270
2008/0224804 A1 * 9/2008 Hagen ..... H01F 7/122 335/170
2009/0128264 A1 * 5/2009 DiSalvo ..... H02H 3/338 335/6
2011/0253918 A1 10/2011 Rampen et al.
2012/0274428 A1 * 11/2012 Reuber ..... H01H 33/66207 335/6
2012/0291506 A1 11/2012 Cheng et al.
2013/0187732 A1 * 7/2013 Bullock ..... H01H 33/6662 335/6
2013/0200966 A1 8/2013 Michaelsen et al.
2013/0328650 A1 * 12/2013 Robertson ..... H01F 7/08 335/234
2015/0155122 A1 * 6/2015 Elberbaum ..... H01H 47/22 307/38
2015/0235784 A1 * 8/2015 Karlstrom ..... H01H 3/60 200/48 R
2015/0270766 A1 9/2015 Mecklenburg
2015/0332880 A1 * 11/2015 Falkingham ..... H01H 33/38 218/142
2016/0314924 A1 * 10/2016 Gaudefroy ..... H01H 50/02
2017/0084412 A1 * 3/2017 Bujotzek ..... H01H 1/385
2017/0154747 A1 * 6/2017 Bissal ..... H01H 50/20

OTHER PUBLICATIONS

Rhefor, "Actuator "Albert" Fact Sheet", Jan. 1, 2014, XP055155085, Retrieved from the Internet on Nov. 26, 2014: URL:http://rhefor.de/en/req/albert_fact_sheet.pdf, 1 page, the whole document.

* cited by examiner

THOMSON COIL BASED ACTUATOR

FIELD OF THE INVENTION

The present invention relates to an actuator for a mechanical switch, a mechanical switch, a circuit breaker and a high voltage power transmission system comprising such an actuator.

BACKGROUND

In power transmission systems, there is a need for fast circuit breakers.

Ultra-fast actuators are a new emerging technology that have been recently used as drives when there is a need of high speed actuation. One well known topology of an ultra-fast drive is the Thomson coil. A Thomson coil comprises a primary coil that induces a magnetic field, which in turn induces eddy currents in an armature. The Thomson coil has the intrinsic property of generating large impulsive forces that actuate and promptly separate the current carrying contacts of a high voltage alternating current (HVAC) circuit breaker.

A circuit breaker of this type may, together with some extra circuitry, be used as DC circuit breaker in power transmission systems such as HVDC systems, where a system may be a multi-terminal system comprising a number of converter stations. A circuit breaker operating in a multi-terminal HVDC system or HVDC grid must be able to interrupt fault currents within some milliseconds, typically, less than 5 ms. For a Thomson coil currents in the order of several kilo Amperes are therefore required to generate a magnetic flux density in the order of several Teslas. The product of the induced current densities in the armature together with the radial component of the magnetic flux density produces the required impulsive electromagnetic forces. Due to the high currents and magnetic fields involved, a Thomson coil is often energized through the use of a capacitor bank.

The main problem of these actuators is their poor efficiency. Compared to rotating electric machines that can attain efficiencies up to 99%, traditional Thomson based ultra-fast actuators have an efficiency of 5% at best. A considerable amount of the electric energy stored in the capacitor bank is unfortunately transformed into heat.

It would in view of this be of interest to raise the efficiency of an actuator that is based on a Thomson coil.

SUMMARY OF THE INVENTION

The present invention addresses this situation. An object of the invention is thus to raise the efficiency of an actuator that is based on a Thomson coil.

This object is according to a first aspect of the invention achieved through an actuator for a mechanical switch, the actuator comprising at least one armature and a first primary coil with turns wound around a central coil axis, where the armature is movable along the central coil axis and a magnetic flux concentrator is provided at least around the first primary coil.

The object is according to a second aspect also achieved through a mechanical switch comprising a first and a second conductor and an actuator according to the first aspect, the actuator being controllable to move one of the conductors in relation to the other in order to make or break a galvanic connection between the first and second conductors.

The object is according to a third aspect achieved through a circuit breaker connected in series with an electrical line for disconnecting the line, the circuit breaker comprising a mechanical switch according to the second aspect.

The object is according to a fourth aspect achieved through a high voltage power transmission system comprising at least one circuit breaker according to the third aspect.

The invention is based on the realization that magnetic flux concentrators are advantageous to be used together with Thomson coils despite the fact that magnetic flux concentrators are known to saturate. In the presence of a magnetic flux concentrator, the total magnetic reluctance of the system decreases. This leads to the creation of a larger magnetic flux in the air gap between coil and armature generating larger repulsive forces. Although the concentrator structure saturates, it will still lead to the creation of larger magnetic fields with each operation if the device being actuated using the actuator is supposed to be used with intermittent operations.

The invention has a number of advantages. It improves the efficiency of the actuator. Due to this increased efficiency, the operating costs of the actuator may be lowered. It is for instance possible that the size of a capacitor bank used to energize the primary coil is reduced. Thereby the cost effectiveness of the actuator is increased. Also the safety is increased, since the risk of explosions is decreased and the voltage levels used may be reduced.

BRIEF DESCRIPTION OF THE DRAWINGS

The present invention will in the following be described with reference being made to the accompanying drawings, where.

DETAILED DESCRIPTION OF THE INVENTION

In the following, embodiments of the invention providing the above described functionality will be described.

The present invention is directed towards providing an actuator that may be used for actuating a mechanical switch for instance in a power transmission system, i.e. in a system for the transmission of electrical power. This system can for instance be a High Voltage Direct Current system (HVDC).

Ultra fast actuators, such as actuators for actuating mechanical switches for instance mechanical switches in power lines, are of interest to be realized as Thomson coils. Thomson coils have the advantage of being fast, which is a requirement in many applications, for instance in some high voltage power transmission applications.

Figure 1:
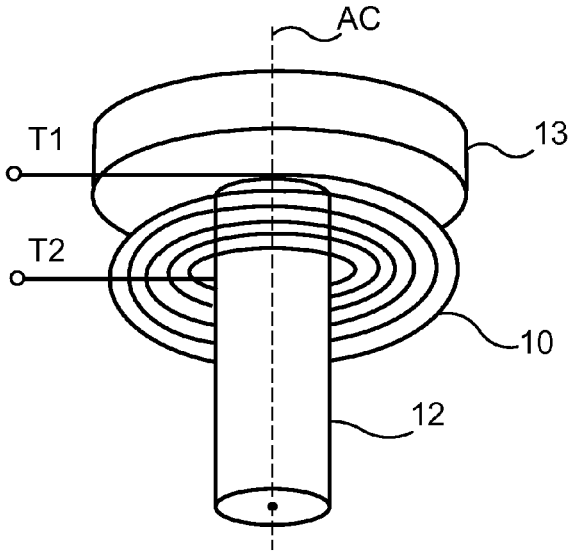
FIG. 1 shows a perspective view of a Thomson coil comprising a primary coil and an armature attached to a rod for use as an actuator, FIG. 2 schematically shows a cross-section of an actuator comprising a housing, the primary coil and the armature with rod extending through the center of the coil, FIG. 3 schematically shows the electrical connection of the primary coil to a capacitor bank via a switch, FIG. 4 schematically shows the use of the Thomson coil and rod in relation to a first and second conductor for forming a mechanical switch, FIG. 5 schematically shows a circuit breaker comprising the mechanical switch of FIG. 4, FIG. 6 schematically shows a multi-terminal HVDC system where transmission lines comprise circuit breakers.

FIG. 1 shows a perspective view of an exemplifying actuator based on a Thomson coil where there is a circular first primary coil 10 with a first and a second electrical connection terminal T1 and T2 and an armature 13. The turns are wound around a central coil axis AC and thereby define a center of the coil 10. The first primary coil may thus have windings that together define a hollow center. The turns of the coil may be laterally displaced from each other along the central coil axis AC and may therefore have the same radius. In the actuator there is also an armature 13. The armature 13 is provided for being moved away from the coil 10 in a direction along the central coil axis AC. The armature 13 is furthermore joined to a rod, often termed a pull rod, and this rod 12 is provided for movement through the center of the coil 10. The armature 13 may for this reason be shaped as a disc, which is joined with the rod or shaft, where the rod 12 may be stretching out from the center of this disc and have a longitudinal axis $A_A$ coinciding with a central axis of this disk as well as with the central coil axis AC.

Figure 2:
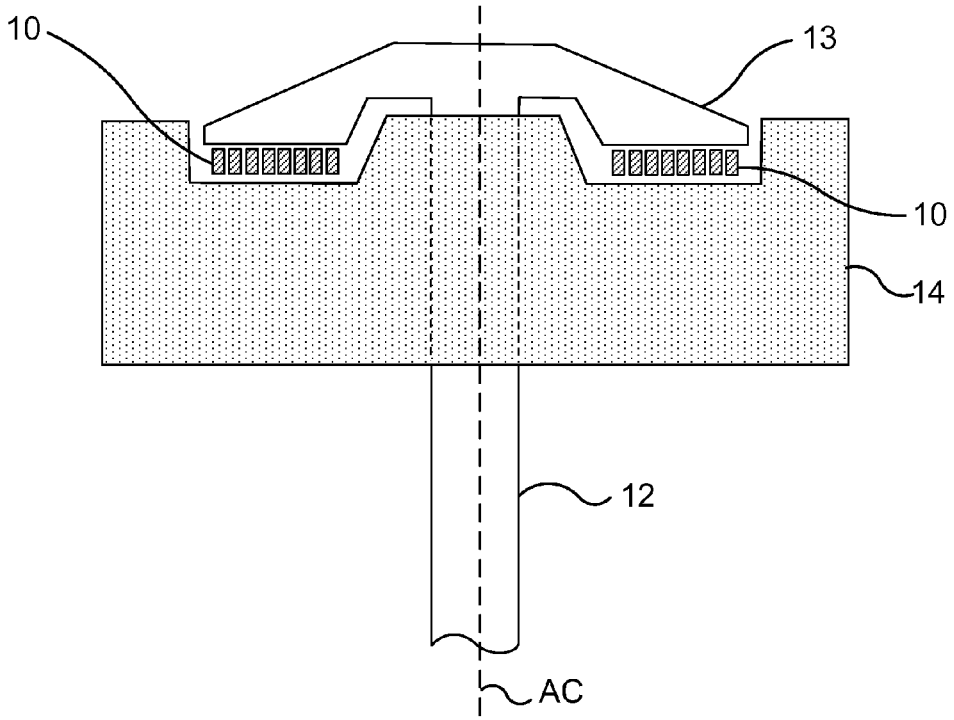

FIG. 2 schematically shows a cross-section of the coil and armature 13 with rod 12 when placed in a housing 14. The housing 14 is provided with a first opening at which the coil 10 is fitted. The armature 13 may be placed on top of the coil 10 outside of the housing 14 with the rod 12 stretching through the first opening, through the interior of the housing 14 and out through a second opening at the bottom of the housing 14. The housing 14 may be rectangular in shape. However this is not necessary. What is of importance is that a magnetic flux concentrator is provided around the coil 10. This magnetic flux concentrator is furthermore in physical contact with the coil. If the coil is circular, the magnetic flux concentrator may radially surround the coil, i.e. surround the coil in the radial direction. In the exemplifying housing the magnetic flux concentrator may be provided at least around the first opening of the housing. It is thus possible that only an annular shaped area of the housing round the first opening is a magnetic flux concentrator. It is also possible that the whole upper surface of the housing perpendicular to the coil axis AC is a magnetic flux concentrator. It is finally possible that the whole housing 14 that encloses the primary coil 10 is a magnetic flux concentrator, which is the case in the embodiment shown in FIG. 2. This magnetic flux concentrator may be of soft magnetic material or soft ferromagnetic material and may therefore as an example be of iron, magnetic steel or a material like permadyne.

Figure 3:
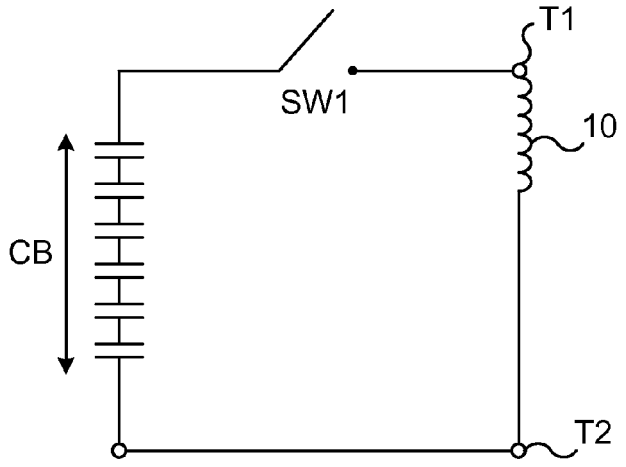

FIG. 3 schematically shows other elements that may be a part of the actuator in order to actuate the armature. There is here a capacitor bank CB comprising a number of series connected capacitors. The capacitor bank CB is selectively connectable to the electrical connection terminals T1 and T2 of the first primary coil 10 in order to maneuver the armature 13. For this reason, one end of the series connection is connected to the first connection terminal T1 of the primary coil 10 via an electronic switch SW1, while the other end may be directly connected to the second connection terminal T2 of the primary coil 10.

Figure 4:
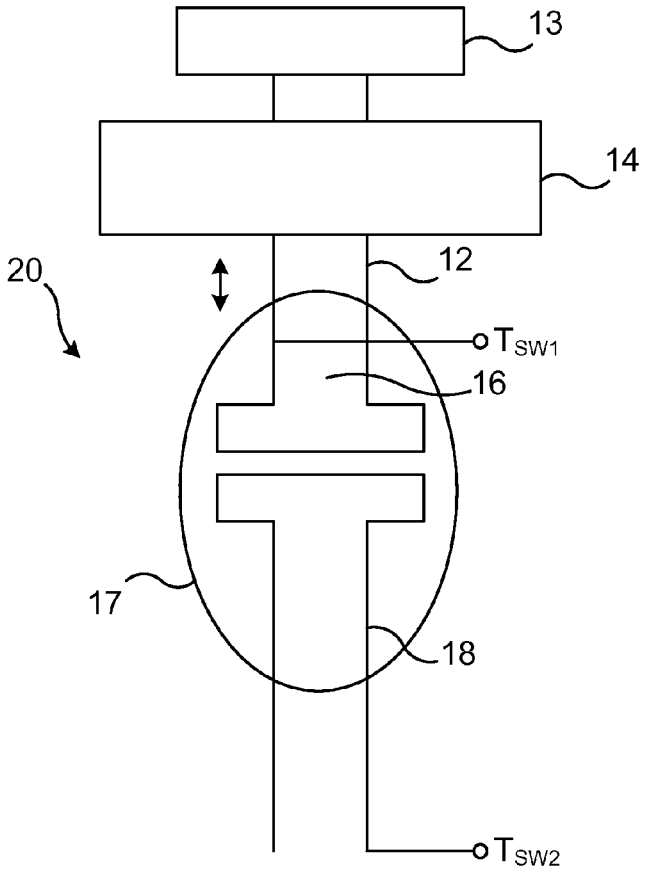

An actuator of the type that is based on a Thomson coil may be provided for a mechanical switch. It may thus be provided for breaking or making a galvanic connection between a first and a second electrical conductor. FIG. 4 schematically shows one such switch where there is a first and a second conductor 16 and 18 in a vacuum, chamber 17. The first conductor 16 is here connected to a first switch terminal $T_{SW1}$, while the second conductor 18 is connected to a second switch terminal $T_{SW2}$ in order to connect the switch 20 to other electric devices. In this switch 20 the second conductor 18 is fixed or stationary, while the first conductor 16 is movable. The rod 12 may be attached to the first conductor 16 set to move in synchronism with the armature 13. The direction of movement may also be the same. Thereby the first conductor 16 may physically connect with the second conductor 18 or vice versa. Through the above mentioned type of movement galvanic contact between the first and second conductor 16 and 18 is made or broken.

In the exemplifying switch 20, the armature 13 may be equipped with means that provides a downward directed force on the rod 12 and thus also forcing the first conductor 16 in galvanic contact with the second conductor 18. In operation of the Thomson coil, the capacitor bank CB will be controlled to provide a current pulse to the coil 10, which creates a magnetic flux that is strong enough for overcoming the downward directed force and push the armature 13 upwards and thereby the rod 12 pulls the first conductor 16 away from the second conductor 18, thereby breaking the galvanic contact between the two conductors 16 and 18.

Figure 5:
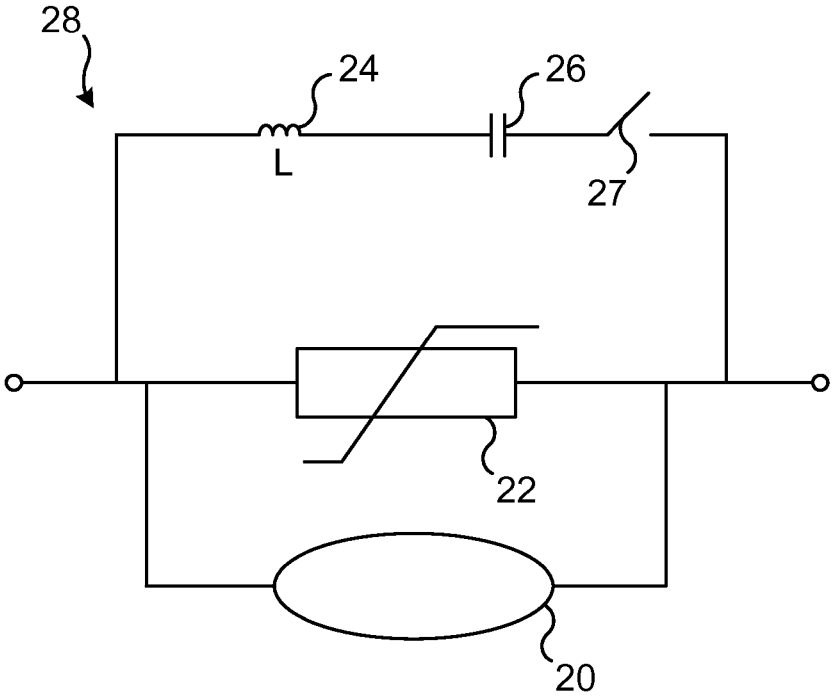

This type of mechanical switch may for instance be placed in a circuit breaker. One circuit breaker 28 that may employ the mechanical switch 20 is schematically shown in FIG. 5. There is here a first branch with the mechanical switch 20. In parallel with this first branch there is a second branch with a non-linear resistor 22, such as a varistor. In parallel with both the first and second branches there is a third branch comprising a series connection of an inductance 24, a capacitance 26 and a further switch 27.

The further switch 27 may be provided as a combination of one or more series connected transistors with anti-parallel diodes or as one or more pairs of anti-parallel transistors, where the transistors may be insulated gate bipolar transistors (IGBTs).

This type of circuit breaker 28 is with advantage used for breaking the current in a power line such as a DC power line in a DC power transmission system. In this case the further switch 27 is controlled to pulse the current through the mechanical switch 20 in order to obtain current zero crossings and in relation to one such zero crossing, the first and second conductors are separated from each other through the movement of the armature.

It should be realized that the above-described circuit breaker is merely one type of circuit breaker in which the mechanical switch may be used. There are countless other realizations that may employ the mechanical switch.

Figure 6:
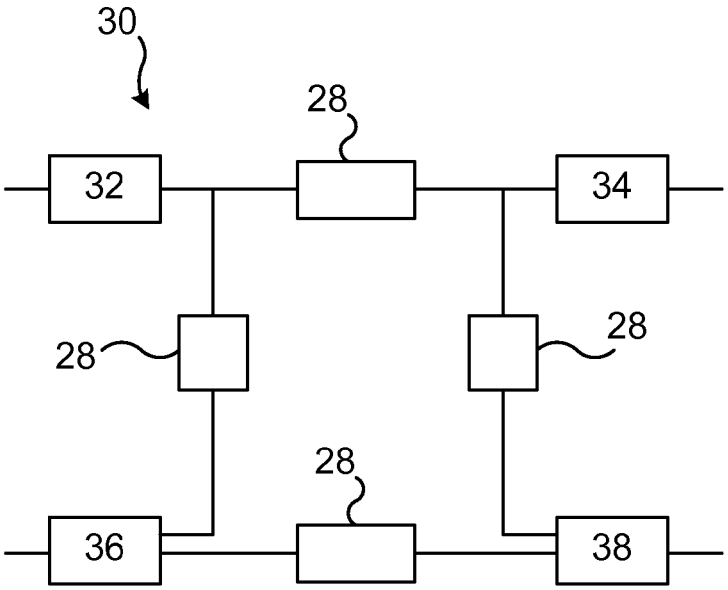

FIG. 6 schematically shows an example of a high voltage system where the circuit breaker 28 may be used. The system is here a multi-terminal DC system, such as an HVDC system comprising a number of converters converting between AC and DC. Each converter comprises an AC side and a DC side, where the DC side of a first converter 32 is connected to the DC side of a second converter 34 via a first DC line 33, the DC side of a third converter 36 is connected to the DC side of a fourth converter 38 via a second DC line 37. There is also a third DC line 38 interconnecting the DC sides of the first and the third converters 32 and 36 as well as fourth DC line 39 interconnecting the DC sides of the second and fourth converters 34 and 38. In the example given here all the DC lines comprise a circuit breaker 28, for instance of the type shown in FIG. 5. Each circuit breaker 28 has the advantage of being fast through employing a mechanical switch based on a Thomson coil. The interconnection may also be considered to form a switch yard in the DC system.

A mechanical switch being actuated by a Thomson coil based actuator of the type shown in FIGS. 1-4 is thus fast. However, as is stated initially the traditional Thomson coil is inefficient. This may be problematic, at least in high voltage applications.

To improve the electric to mechanical energy conversion process, it is here proposed to use a magnetic flux concentrator in the actuator. As stated earlier, the magnetic flux concentrator may be made of a soft magnetic material such as iron or any other ferromagnetic media, such as for instance permadyne, and is used to boost the efficiency of the ultra-fast electromagnetic actuator.

This is a new concept especially for applications involving such high magnetic field levels, for instance above 5 Teslas, or around 10 Teslas and above. Traditionally, the housing enclosing the spiral coil that generates the magnetic field is a non-magnetic stainless steel housing that adds mechanical stability. According to the first embodiment a magnetic flux concentrator is used as a housing instead. This will raise the efficiency of the drive considerably.

Intuitively, one may often reach the misleading conclusion that since these materials saturate they are unsuitable for use in high magnetic fields.

The invention is based on the realization that if the actuator is to be used infrequently, which is the case if it used for a circuit breaker, then this saturation is no real problem.

Unlike transformers or motors, the Thomson coil has an intermittent operation. Although within such operation, high field levels the concentrator will saturate, it will still be able to help build up the flux rapidly as the concentrator provides a low magnetic reluctance flux path. Therefore, with the same current, a higher field will be generated and thus larger currents will be induced in the armature. This will result in a larger force within the same amount of time thereby significantly increasing performance.

In the presence of a magnetic concentrator, the total magnetic reluctance of the system decreases. This leads to the creation of a larger magnetic flux in the air gap between coil and armature generating larger repulsive forces than without such a concentrator. Although the concentrator structure saturates, it will still lead to the creation of larger magnetic fields with each operation since the circuit breaker is supposed to be used with intermittent operations.

Figure 7:
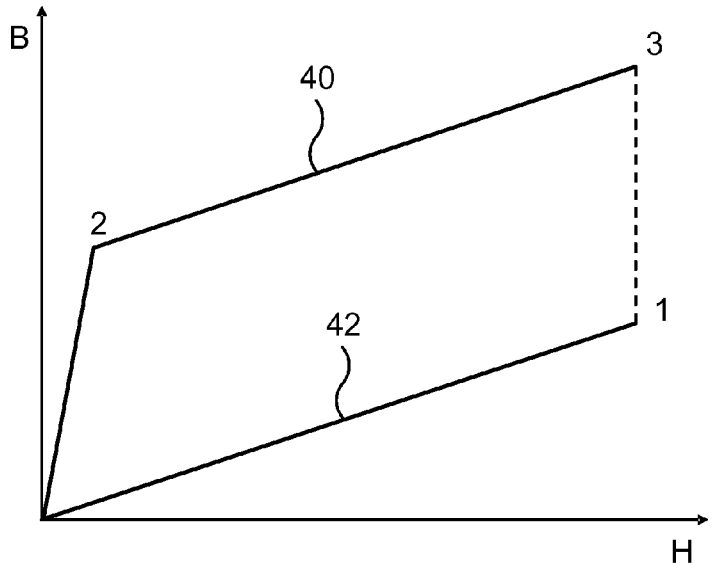
FIG. 7 shows a curve of the relationship between the magnetic flux density and the magnetic field strength of soft magnetic material and air, respectively.

This can be understood from looking at FIG. 7, which shows a curve 40 of the relationship between the magnetic flux density B and the magnetic field strength H of soft magnetic material and a curve 42 of the relationship between the magnetic flux density B and the magnetic field strength H of air.

The magnetic flux concentrator creates a low reluctance path increasing the magnetic field and although the material of the concentrator saturates (points 2 to 3), the field in point 3 is higher than the field in point 1 (which will be the case if a non-magnetic material will be used).

The use of a magnetic flux concentrator raises the efficiency considerably. Due to this increased efficiency, the operating costs of the actuator may be considerably lowered. It is for instance possible that the size of the capacitor bank is reduced. The lower the number of capacitors, the more cost effective the actuator is, and the safer it is since this decreases the risk of explosions. It also adds to the safety though the use of a lower voltage.

If the mechanical switch is used for disconnecting a power line in the case of a fault, such as in the case of pole to ground fault, a lot of energy can be saved since these capacitors have to be constantly charged to maintain their voltage levels until the next fault appears. Moreover, if the same energizing source is decided to be kept, then the performance of the drive will be radically increased due to the concentrators.

Ideally, the concentrator should be placed in a way to close the magnetic path and reduce reluctance. Instead of using mechanically strong non metallic materials (e.g. Bakelite, concrete, fiber glass) or non-magnetic stainless steel, a ferromagnetic or a magnetic flux concentrator or perhaps one of permadyne should be used. This shows the potential of using magnetic material such as iron or steel for ultra fast actuators.

It is possible that two Thomson coils are used. One may be used for making a galvanic contact and the other for breaking a galvanic contact. In this case there may be a first and a second primary coil, each placed in an opening of a corresponding housing, where one or both may act as magnetic flux concentrator. The primary coils are then facing each other where both may be centered around the same central coil axis. Through these two Thomson coils it is possible that a single armature joined with a rod is set to move between the two coils.

Figure 8:
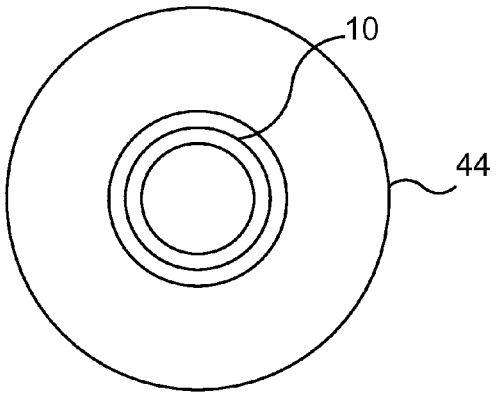
FIG. 8 shows a view from above of a second variation of a coil and magnetic flux concentrator.

In the first embodiment described above the concentrator was a part of a housing. It should be realized that the invention is not limited to this concept. FIG. 8 shows a view from above of a second type of concentrator together with a coil. In this case the concentrator is annular and radially surrounds the coil 10. The concentrator may in this case be in the form of an annular disc 44, having a center hole in which the coil is fitted.

Figure 9:
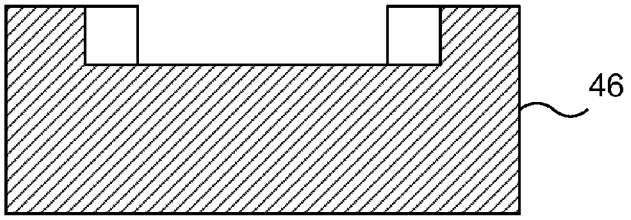
FIG. 9 shows a side view of a third variation of a coil and magnetic flux concentrator.

FIG. 9 shows a cross-section through a third type of concentrator and coil. The concentrator may in this case be in the form of a solid block 46 having a cavity designed for receiving and holding the coil 10.

The invention was above described in relation to high voltage operation. It should however be realized that it is not limited to this field. The actuator may this for instance be used for low, medium, and high voltage breakers. The actuator is actually not limited to be used in circuit breaker, but may for instance be used in a robot as well.

The invention claimed is:

1. An actuator for a mechanical switch, said actuator comprising:

at least one armature connected to a rod;

a first primary coil with turns wound around a central coil axis defining a center of the coil;

a first housing for receiving the rod and provided with a first opening; and a magnetic flux concentrator made up of at least a part of the first housing, said magnetic flux concentrator at least surrounding the first opening of the housing and at least surrounding an entire outer lateral side of the first primary coil and in physical contact with the first primary coil, wherein the actuator is based on a Thomson coil, the first coil is fitted at the first opening and the armature is placed on top of the coil outside of the housing and movable away from the coil in a direction along the central coil axis with the rod provided for movement through the center of the coil.

2. The actuator according to claim 1, wherein the whole housing is a magnetic flux concentrator.

3. The actuator according to claim 2, wherein the material of the magnetic flux concentrator is a soft magnetic material.

4. The actuator according to claim 2, wherein the first primary coil has electrical connection terminals and further comprising a capacitor bank selectively connectable to the electrical connection terminals of the first primary coil in order to maneuver the armature.

5. The actuator according to claim 2, further comprising a second primary coil of the same structure as the first primary coil, where the second primary coil is centered around said central coil axis for allowing the armature to be moved back and forth between the first and second primary coils.

6. A mechanical switch comprising:

a first conductor;

a second conductor; and the actuator according to claim 2, said actuator being controllable to move one of the conductors in relation to the other in order to make or break a galvanic connection between the first and second conductors.

7. The actuator according to claim 1, wherein the material of the magnetic flux concentrator is a soft magnetic material.

8. The actuator according to claim 7, wherein the first primary coil has electrical connection terminals and further comprising a capacitor bank selectively connectable to the electrical connection terminals of the first primary coil in order to maneuver the armature.

9. The actuator according to claim 7, further comprising a second primary coil of the same structure as the first primary coil, where the second primary coil is centered around said central coil axis for allowing the armature to be moved back and forth between the first and second primary coils.

10. A mechanical switch comprising:

a first conductor;

a second conductor; and the actuator according to claim 7, said actuator being controllable to move one of the conductors in relation to the other in order to make or break a galvanic connection between the first and second conductors.

11. The actuator according to claim 1, wherein the first primary coil has electrical connection terminals and further comprising a capacitor bank selectively connectable to the electrical connection terminals of the first primary coil in order to maneuver the armature.

12. The actuator according to claim 11, further comprising an electrical switch for selectively connecting the capacitor bank to the electrical connection terminals.

13. The actuator according to claim 12, further comprising a second primary coil of the same structure as the first primary coil, where the second primary coil is centered around said central coil axis for allowing the armature to be moved back and forth between the first and second primary coils.

14. The actuator according to claim 11, further comprising a second primary coil of the same structure as the first primary coil, where the second primary coil is centered around said central coil axis for allowing the armature to be moved back and forth between the first and second primary coils.

15. The actuator according to claim 1, further comprising a second primary coil of the same structure as the first primary coil, where the second primary coil is centered around said central coil axis for allowing the armature to be moved back and forth between the first and second primary coils.

16. A mechanical switch comprising:

a first conductor;

a second conductor; and the actuator according to claim 1, said actuator being controllable to move one of the conductors in relation to the other in order to make or break a galvanic connection between the first and second conductors.

17. A circuit breaker connected in series with an electrical line for disconnecting the line, the circuit breaker comprising the mechanical switch according to claim 16.

18. A high voltage power transmission system comprising at least one of the circuit breaker according to claim 17.

19. The high voltage power transmission system according to claim 18, wherein the system is a multi-terminal high voltage power transmission system.

20. The high voltage power transmission system according to claim 18, wherein the system is a DC system.

* * * * *